United States Patent [19]

Beckers

[11] Patent Number: 4,625,506

[45] Date of Patent: Dec. 2, 1986

[54] OPEN-END SPINNING PROCESS AND DEVICE

[75] Inventor: Michel Beckers, Verviers, Belgium

[73] Assignee: Societe Anonyme des Ateliers Houqet Duesberg Bosson, Verviers, Belgium

[21] Appl. No.: 540,765

[22] Filed: Oct. 11, 1983

[30] Foreign Application Priority Data

Oct. 8, 1982 [BE] Belgium ..... 0/209,204

[51] Int. Cl.[4] ..... D01H 1/135; D01H 7/885

[52] U.S. Cl. ..... 57/413; 57/404; 57/417

[58] Field of Search ..... 57/400, 404, 413, 408, 57/417

[56] References Cited

U.S. PATENT DOCUMENTS

| | | | |
|---|---|---|---|
| 2,926,483 | 3/1960 | Keeler et al. | 57/400 |
| 3,115,001 | 12/1963 | Cizek et al. | 57/413 |
| 3,126,697 | 3/1964 | Cizek et al. | 57/413 |
| 3,620,002 | 11/1971 | Grishin | 57/413 |
| 3,703,074 | 11/1972 | Staneff | 57/413 X |

FOREIGN PATENT DOCUMENTS

| | | |
|---|---|---|
| 1965605 | 7/1970 | Fed. Rep. of Germany . |
| 2123757 | 11/1972 | Fed. Rep. of Germany . |
| 2320822 | 11/1974 | Fed. Rep. of Germany . |
| 448826 | 4/1968 | Switzerland . |

*Primary Examiner*—John Petrakes
*Attorney, Agent, or Firm*—Walter H Schneider

[57] ABSTRACT

An "open-end" method of spinning using a device comprising a supply device, a disintegrating means, a rotor, an outlet end member, a supply device and a winding device, characterized in that means are provided for giving the "fibre deposition zone" (11) a speed equal to that of the "fibre formation zone" and in that the zones are actuated so that the fibres (10) coming from the disintegrator cannot be deposited on the thread (14) being formed.

2 Claims, 2 Drawing Figures

OPEN-END SPINNING PROCESS AND DEVICE

Figure 1:
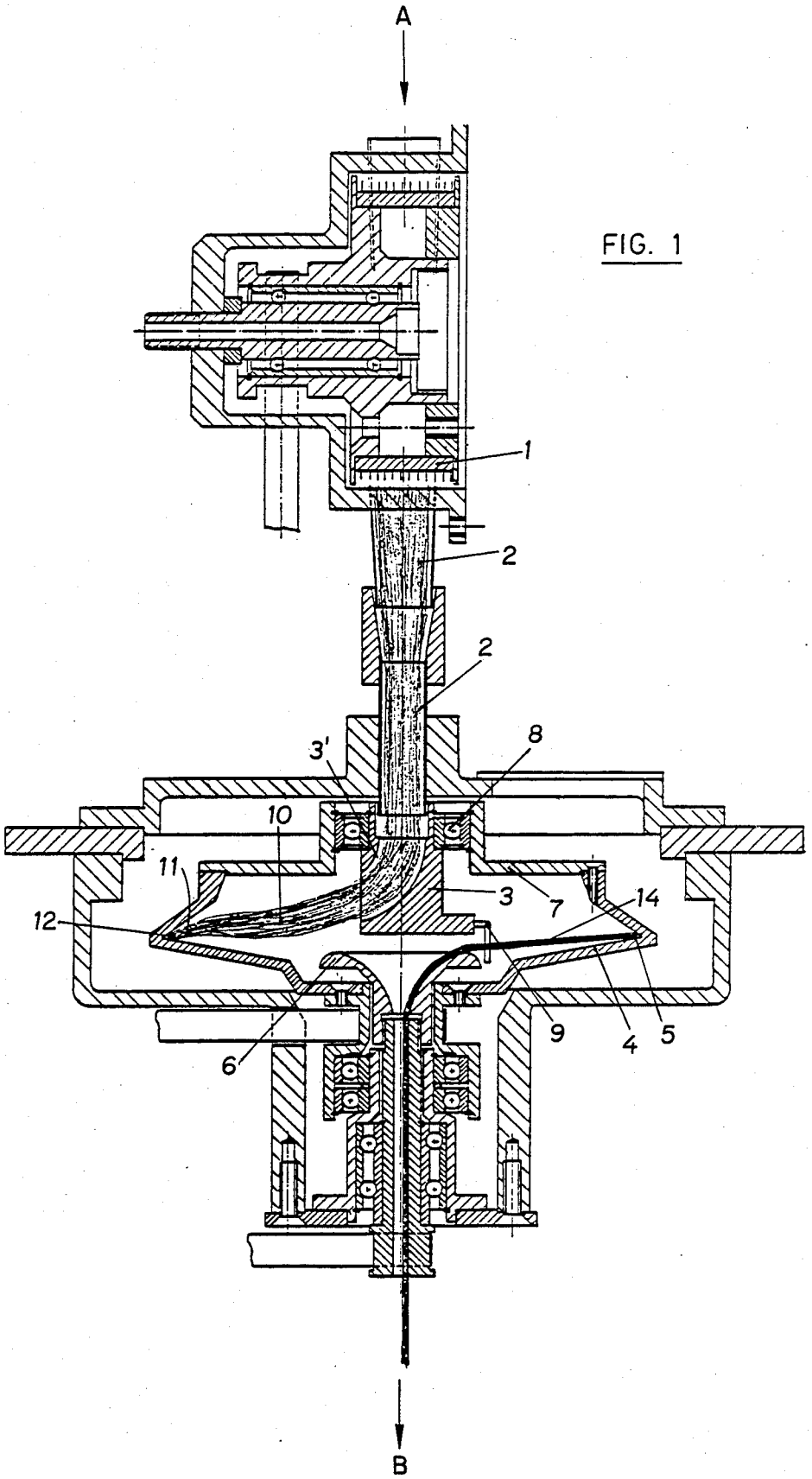

The invention relates to a method and apparatus for "open-end" spinning.

As is well known, every "open-end (or free-fibre) rotor" spinning machine comprises the following components:

A supply device for supplying a sliver or strand of fibres coming from a preparation machine;

A disintegrator means for separating the fibres and having teeth or needles for rapidly pulling the fibres out of the end of the strand supplied to it by the supply device;

A rotor for collecting the released fibres and gathering them in a circular groove to form a ring of fibres for conversion by torsion into a continuous thread;

An outlet nozzle or funnel or end member (the latter term will be used hereinafter) through which the thread, when it comes loose from the rotor groove, can leave the chamber in which the rotator rotates;

A thread delivery means for driving the finished thread and giving it the tension required for pulling it outside the rotor, and A winding device for coiling the finished thread.

The disintegrator, which comprises a cylinder having teeth or needles, can have the same axis of symmetry and rotation as the rotor, in which case the device is called coaxial. If the axes are different the device is called biaxial.

In a coaxial device, the disintegrator extends partly into the rotor. The strand of fibres is brought to a zone, fixed in space, where the fibres are placed in contact with the disintegrator teeth and are pulled out of the strand. They are then conveyed on the disintegrator teeth for a time and then, through centrifugal force, come loose from the teeth and are thrown into and collect in the rotor groove. The exact place where the fibres come away from the disintegrator and are thrown into the rotor is difficult to determine since it depends on a number of factors such as the speed of the disintegrator, the type of teeth, the type of fibres, the suction produced by the rotation of the rotor, etc.

It is therefore assumed that under certain operating conditions, the fibres are deposited in the rotor in a given but unknown zone hereinafter called the "fibre deposition zone". This zone refers to space and not to the rotor, since the latter is rotating continously.

In a biaxial device the fibres cannot enter the rotor at the exact moment when they come loose from the disintegrator, since the disintegrator is at a greater distance from the rotor. They are therefore conveyed from the disintegrator to the rotor along a channel by a flow of air which collects them at the disintegrator outlet, which is also the channel inlet and conveys them to the channel outlet, which is also the rotor inlet.

The exact place where the fibres are thrown into the rotor is therefore well known, since it is the channel outlet.

The fibres are therefore deosited in the rotor in a given, known zone, which hereinafter will also be called the "fibre deposition zone". This zone refers to space and not to the rotor, since the latter is rotating continuously.

Whether therefore the device is coaxial or biaxial, a "fibre deposition zone" exits where fibres are deposited in the rotor groove. Under given conditions, the zone is fixed in space.

We shall now consider the process of forming the thread:

The technique of thread formation is well known. The end of a thread is inserted through the end member into the rotor. The thread end, through centrifugal force, moves towards the rotor groove and mixes with the ring of fibres coming from the disintegrator. The thread is then inserted into the delivery device, which then pulls it out of the rotor. The thread end which has mixed with the ring of fibres in the rotor is driven in rotation by the rotor and twists. The torsion is communicated to the ring of fibres in the rotor, which is in contact with the thread end. The ring of fibres opens and one end becomes intimately linked by torsion to the end of the thread and becomes integral therewith.

Since the thread is held in the delivery device, it is pulled out of the rotor. The thread is then said to be started and the process becomes continuous. The disintegrator constantly supplies fibres to the rotor to reform the ring of fibres, and the delivery device constantly pulls the ring of fibres from the rotor after it has become a thread by torsion.

The ring of fibres which becomes a thread by torsion comes loose from the rotor groove at a specific zone in the rotor before moving towards the outlet end member. This zone, which will hereinafter be called the "thread formation zone" is not fixed relative to the rotor, since if it was fixed in the rotor, the thread could not be delivered. The "thread formation zone" therefore moves continuously in the rotor, with a speed such that the difference between the absolute linear speed of the thread formation zone and the peripheral speed of the rotor at its groove is equal to the thread delivery (or production) speed.

The following two important zones therefore exist in the open-end spinning process:

A fibre arrival zone, i.e. the "fibre deposition zone", which is fixed in space and therefore has an absolute rotation speed equal to zero, and A thread departure zone, i.e. the "thread formation zone", having an absolute speed of rotation which we shall call Nf (slightly above the absolute speed of rotation of the rotor, which we shall call Nr).

The two zones therefore meet at a frequency equal to Nf. Whenever the "thread formation zone" enters the "fibre deposition zone", the fibres coming from the disintegrator will be deposited on the thread being formed by torsion before they can be deposited in the rotor groove and combine with the other fibres to form the previously-mentioned ring of fibres. The fibres which are deposited on the thread being formed are taken up by the torsion on the thread before they can become aligned with and parallel to the other fibres. They therefore produce a defect called "bundling". The amount of bundling increases with the length of fibres, which means that open-end spinning is unsuitable for long fibres.

The invention aims to obviate this disadvantage, to eliminate "bundling" and thus enable long fibres to be spun on an "opne-end" machine.

To this end, the method according to the invention is characterised in that the "fibre deposition zone" in the rotor groove is given a speed equal to that of the "thread formation zone" and the zones are actuated so that the fibers coming from the disintegrator cannot be deposited on the thread being formed in the rotor groove. The invention also comprises an apparatus for practising the method.

Figure 2:
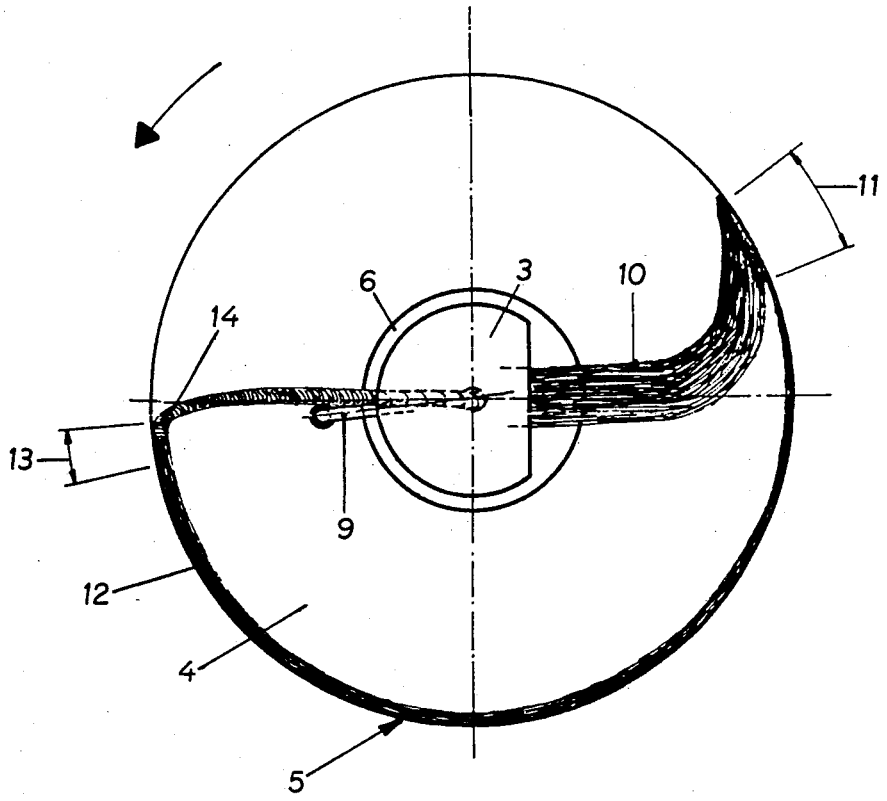

The method and apparatus will be explained hereinafter with reference to the drawings in which, by way of nonlimitative example, show a device which can be used for working the method. In the drawings:

FIG. 1 is a view in lateral section of a spinning device according to this invention, and FIG. 2 is a plan view illustrating the device and showing the "fibre deposition" and "thread formation" zones.

In the embodiment, the biaxial disintegrator principle will be used.

The disintegrator diagrammatically shown, by way of example, at 1 in FIG. 1 is associated with means represented generally by "A" for supplying a strand of fibers to it.

The basic feature of the invention is to give the "fibre deposition zone", shown at 11, a speed equal to that of the "thread formation zone" 13 (see FIG. 2) and to actuate these zones so that the fibres 10 coming from disintegrator 1 cannot be deposited on the thread 14 being formed. Thread delivery means and thread winding means, represented generally by the letter "B" in FIG. 1, place the finished thread 14 under tension causing it to be pulled from rotor 4 through outlet end member 6 for coiling.

If the "fibre deposition zone" 1 and the "thread formation zone" 13 are driven at the same speed and do not overlap at any point, the fibres 10 coming from disintegrator 1 will be deposited in the groove 5 of rotor 4 at a place where the thread 14 is not present. They can thus become incorporated in the ring 12 of fibres before being subjected to torsion, and since this situation continues indefinitely since the aforementioned two speeds are equal, bundling will never occur.

In the accompanying drawings, a fibre conveying channel 2 conveys fibres 10 from the outlet of disintegrator 1 to rotor 4. Channel 2 is disposed along the axis of rotor 4.

Channel 2 is prolonged by a component 3 comprising a bent duct $3^1$ which deflects fibres 10 from channel 2 and conveys them towards rotor groove 5. Component 3 is driven at the speed of rotation of the "thread formation zone" 13, either by electric or electronic means synchronizing the speed of component 3 with the speed of the "thread formation zone" 13 (FIG. 2) or by mechanical means forcing thread 14 to drive the bent duct $3^1$ for supplying the fibres.

To this end, a means comprising e.g. a "finger"-shaped rod secured to component 3 is provided at 9 and extends sufficiently towards the bottom of rotor 4 to be in the path of thread 14, so that the thread, during its rotation, is forced against the rod and consequently has to drive component 3 in rotation.

The "thread formation zone" 13 and the outlet of duct 3' are offset so that the fibres cannot be deposited on thread 14 in zone 13.

If thread 14 is forced to drive component 3 for supplying and deflecting the fibres, thread 14 must of course drive duct $3^1$ at the same speed as zone 13. This may produce excessive tension in thread 14.

Excessive tension can be avoided by the following special feature:

Component 3 is mounted so that it can rotate freely, e.g. on ball bearings 8, on a component 7 secured to rotor 4.

When rotor 4 rotates, component 7 is also rotated at the same speed, in which case thread 14 needs to give component 3 a speed only equal to the difference between the speed of zone 13 and the speed of rotor 4.

The invention is not limited to this embodiment but applies to any embodiment based on the same principles.

I claim:

1. In an open end spinning device in which a strand of fibers is fed to a disintegrator which separates the individual fibers and conveys them through a conveying channel to a rotor in which they are delivered to a fiber deposition zone fixed in space with respect to said rotor when in motion and in which said fibers are collected in a circular groove in the face of said rotor in the form of a ring of aligned and parallel fibers which are then converted by torsion into a continuous thread in a thread formation zone, said continuous thread being withdrawn from said rotor by thread delivery and thread winding means, the tension placed on said continuous thread by said delivery and thread winding means causing said thread formation zone to continuously move in space with respect to said rotor when in motion, the improvement for preventing the overlapping of said zones and the deposition of fibers on said continuous thread before they can become aligned with and parallel to each other in said ring of fibers, which comprises: a tubular component axially aligned with said fiber conveying channel and said rotor for receiving fibers from said conveying channel and directing them into the circular groove in the face of said rotor, said tubular component being mounted with respect to said rotor for separate rotation, and means associated with said tubular component and with said continuously moving thread whereby the motion of the latter is conveyed to said tubular element thereby providing thereto a speed of rotation equivalent to the difference between the speed of said thread formation zone and that of said rotor, whereby said fiber deposition zone and said thread formation zone are caused to move at corresponding speeds.

2. The improvement according to claim 1 in which the means associated with said tubular element comprises an extension thereof protruding downwardly therefrom so as to contact said continuously moving thread thereby conveying the motion of said thread to said tubular element.

* * * * *